United States Patent [19]

Von Braun

[11] 4,355,826

[45] Oct. 26, 1982

[54] CONTAINMENT SKIRT FOR DRILLING FLUID

[76] Inventor: Daun W. Von Braun, P.O. Box 498, Spruce Grove, Alberta, Canada

[21] Appl. No.: 175,893

[22] Filed: Aug. 6, 1980

[51] Int. Cl.[3] ..... F16L 55/00

[52] U.S. Cl. ..... 285/45; 285/197; 285/373

[58] Field of Search ..... 285/45, 419, 373, 333, 285/334, 197

[56] References Cited

U.S. PATENT DOCUMENTS

| | | | |
|---|---|---|---|
| 2,708,123 | 5/1955 | Risley et al. | 285/45 |
| 3,007,722 | 11/1961 | Anderson et al. | 285/419 |
| 3,030,601 | 4/1962 | Krebs | 285/45 X |
| 3,229,998 | 1/1966 | Pennington | 285/419 |
| 3,310,322 | 3/1967 | Carroll | 285/45 X |
| 3,475,038 | 10/1969 | Matherne | 285/419 X |
| 3,869,150 | 3/1975 | Brown | 285/333 X |
| 4,058,328 | 11/1977 | Nickerson et al. | 285/45 |
| 4,165,111 | 8/1979 | Zanichelli | 285/419 |
| 4,176,756 | 12/1979 | Gellman | 285/419 X |

*Primary Examiner*—Thomas F. Callaghan
*Attorney, Agent, or Firm*—Browdy and Neimark

[57] ABSTRACT

A flexible drilling fluid skirt for well drilling use. The skirt is wrapped around a drill pipe connection before loosening to contain pressurized spray of drilling fluid and direct the fluid to storage or for re-use.

2 Claims, 13 Drawing Figures

CONTAINMENT SKIRT FOR DRILLING FLUID

The present invention relates to a containment skirt for use during well drilling or production operation. More particularly, the present invention relates to a flexible structure adapted to be wrapped around a well tool or pipe line connection and which prevents splattering and/or loss of well drilling fluid or mud during loosening of the connection. Use of the wrapping skirt of the invention also assists in keeping the well site clean, increasing worker efficiency and reducing the possibility of accident and injury.

The use of well drilling fluid or mud or water during drilling operations is used to increase the life of the drilling components and to flush the bore hole of crushed rock chips, sand, and the like. It is frequently necessary to connect and disconnect various drill tools and drill pipe lengths and as the drilling fluid or mud is often present under pressure within these components, each loosening or disconnection of the various components can result in a splattering and/or loss of the drilling mud and this is to be avoided if possible because of cost. Another factor is that splattering of drilling fluid around a drill site makes the area very slippery and this increases worker accident and injury while at the same time lowering worker production. It is common practice to clean around a well site by using water but this procedure has a double disadvantage—it requires worker time, and in freezing conditions, a layer of ice builds up on the drilling platform making it even more difficult for the workers to efficiently perform their job. The presence of ice requires the application of sawdust or other friction increasing material and this increases cost and requires further worker effort.

DESCRIPTION OF PRIOR ART

Present attempts to avoid this splattering and/or loss of drilling fluid involves the use of so-called "mud cans" which are of solid metal construction which are placed around the pipe joint and which function to minimize splattering and loss of the relatively expensive drilling mud. A disadvantage of mud cans, however, is that they are large and heavy and cumbersome and the positioning and removal of these mud cans from around the pipe lengths is a time-consuming and strenuous job and when the mud cans are not required, they clutter up the drilling platform.

THE PRESENT INVENTION

The present invention avoids the difficulties inherent in the prior art devices by providing a flexible wrapping skirt which is lightweight in construction and which can easily be handled by one or at most two men (depending upon the pressures involved) and which may be kept readily at hand for use.

The skirt wrapping according to the present invention is preferably molded for suitably reinforced rubber or plastic compositions which are durable in use and which retain their flexibility during freezing conditions.

The device of the invention has a flexible body portion which is provided on its outer surface with two handles which facilitate positioning of the structure around a pipe tool joint. When drilling fluid pressure within the drill line is minimal the device can simply be held in position by one worker during loosening and removal of the connection, but when greater pressures are involved one embodiment of the present device includes suitable locking means to securely position the wrapping around the pipe connection before the joint is loosened and separated. This positioning can quite easily be accomplished in a minimum of time by two workers, one worker by simply using the handles provided by holding the wrapping in position and the other worker securing the locking means.

In one embodiment, the device is provided around the upper portion of its inner surface with pipe contacting sealing means to prevent passage of pressurized drilling mud upwardly between the wrapping and the pipe connection. This contacting and sealing means will be positioned around the connection above the joint, and the downward skirting provided on the device will then direct drilling fluid or mud issuing from the joint downwardly through the slip and flow nipples around the bore hole and thus back into the bore hole. This alone results in a saving of expensive drilling fluid or mud.

In the embodiment discussed above, channels or grooves are molded into the skirt enabling the drilling fluid or mud under pressure to pass downwardly into the drill hole.

In a further embodiment of the invention, pipe contacting and sealing means are provided on the inner surface of the skirt in both the top and bottom portions so that sealing of the skirting around the connection occurs both above and below the connection joint. In this embodiment, tubing extends centrally from the skirt to convey drilling fluid or mud to suitable storage and/or reuse.

Vertical edges of the skirt wrapping may be provided with surfaces in the form of ribs and grooves or the like which when the skirt is wrapped around the drilling string, provide for further secure closure of the skirt around the connection.

OBJECTS OF THE PRESENT INVENTION

The principle object of the present invention is to provide a drilling fluid skirt for use during well drilling and production and which consists of a flexible skirt body portion adapted to be wrapped around a pipe connection to contained pressurized spray of drilling fluid or mud during loosening of the connection and which is durable and of light weight while providing ease of use and convenience of storage.

A further more specific object of the invention is to provide a drilling fluid skirt for well drilling use, and which is wrapped around a drill pipe or well tool connection having upper and lower connecting parts prior to loosening of the connecting parts to contain pressured spray of drilling fluid, mud or water and minimize loss thereof.

The skirt comprises a flexible body portion of length greater than the circumference of the connection about which it is adapted to be wrapped to cover adjacent portions of the connecting parts.

The skirt has an outer surface and handles provided on the outer surface to facilitate positioning, the skirt having an inner surface with at least the upper portion of the inner surface being provided with sealing means for contact with the upper connecting part to prevent passage of drilling fluid or mud or water therebetween, and discharge means for discharging drilling fluid or mud or water from within the skirt.

In one embodiment the skirt is provided with upper and lower sealing means and a central discharge opening with associated connections and tubing to convey drilling fluid or mud to storage and/or re-use.

BRIEF DESCRIPTION OF ACCOMPANYING DRAWINGS

The present invention will now be defined in greater detail with reference to the accompanying drawings wherein.

DETAILED DISCUSSION OF DRAWINGS

Figure 1:
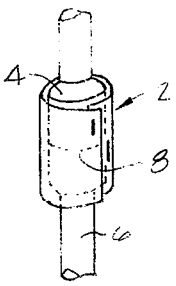
FIG. 1 is a perspective view showing the partial positioning of the present wrapping skirt around a pipe joint.
Figure 6:
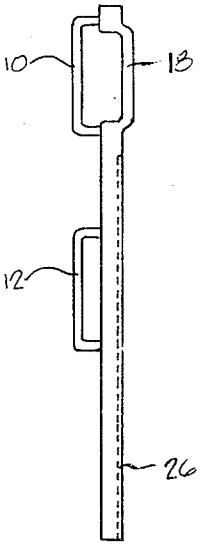
FIG. 6 is a view of one end of the structure as shown in FIG. 2.

Reference will now be had to the accompanying drawings in detail, and wherein like reference numerals refer to like parts.

The present invention is shown in FIG. 1 by the numeral 2 where it is partially wrapped around a drill pipe connection consisting of upper 4 and lower 6 component parts. The upper and lower parts 4 and 6 may be drill pipe or drill pipe/pipe tool connections which as understood are threadedly secured together. FIG. 1 clearly shows the positioning of the present skirt around the connection so that the joint 8 between the component parts 4 and 6 is covered by the skirting.

As will clearly be understood from accompanying FIGS. 2 through 6, the wrapping skirt 2 has a generally rectangular configuration having outer (FIG. 2) and inner (FIG. 4) surfaces, the outer surface being provided with handles 10 and 12 to facilitate positioning of the structure around the pipe joint. The handles 10 and 12 may conveniently be of metallic construction such as wire rope having a covering of vulcanized rubber or the like and the skirt itself is preferably of molded reinforced construction.

Figure 2:
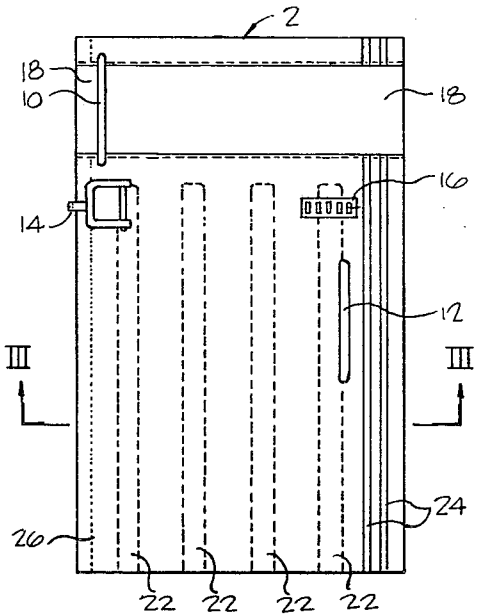
FIG. 2 is a side view of the outer surface of the present skirt.
Figure 3:
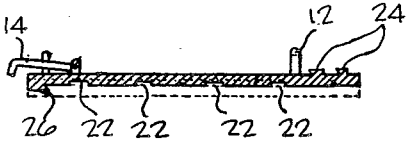
FIG. 3 is a sectional view taken along line III—III of FIG. 2.

After the skirt is wrapped around the pipe joint as shown in FIG. 1, it may be secured in position by suitable locking means as shown in FIGS. 2 and 3. In the specific embodiment shown in these Figures, the locking means consists of a pivotally mounted locking arm 14 which is adapted to be received in any of a number of receiving holes provided in metallic band 16, the actual hole which will be selected will of course be dependent upon the diameter of the pipe connection about which the skirt is positioned. However, it will be appreciated that various types of locking arrangements could conveniently be used.

Figure 4:
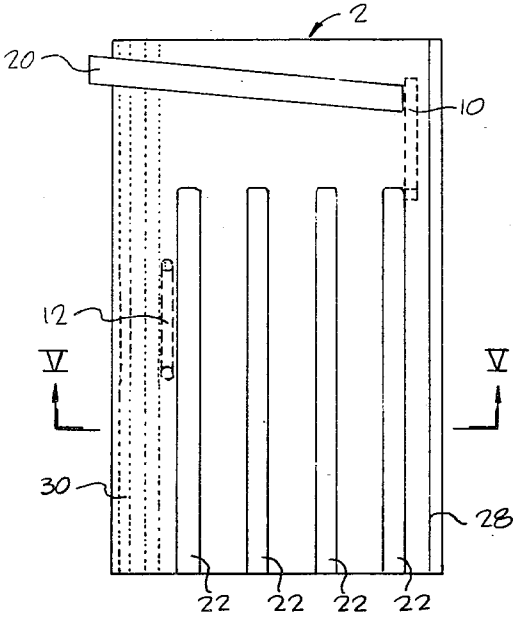
FIG. 4 is a side view of the inner surface of the present invention.
Figure 5:
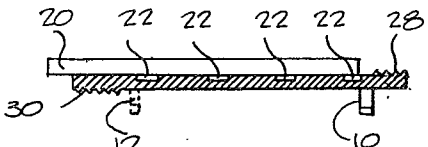
FIG. 5 is a sectional view taken along line V—V of FIG. 4.
Figure 10:
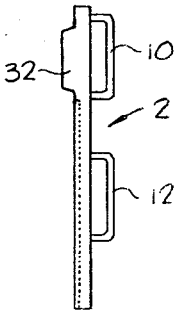
FIG. 10 is a view of one end of the embodiment shown in FIG. 7.
Figure 7:
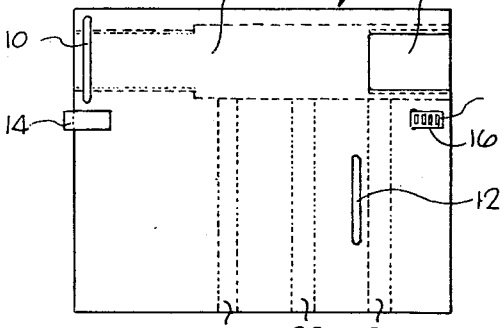
FIG. 7 is a side view of a further embodiment of the present invention showing the outer surface of the skirt.
Figure 8:
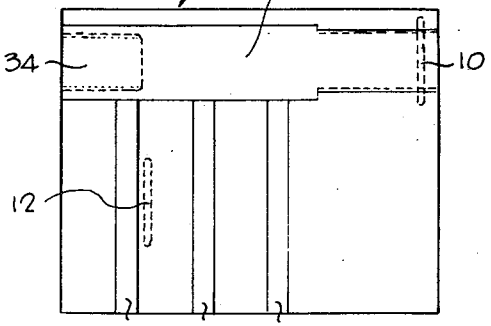
FIG. 8 is a side view of the inner surface of the embodiment as shown in FIG. 7.
Figure 9:
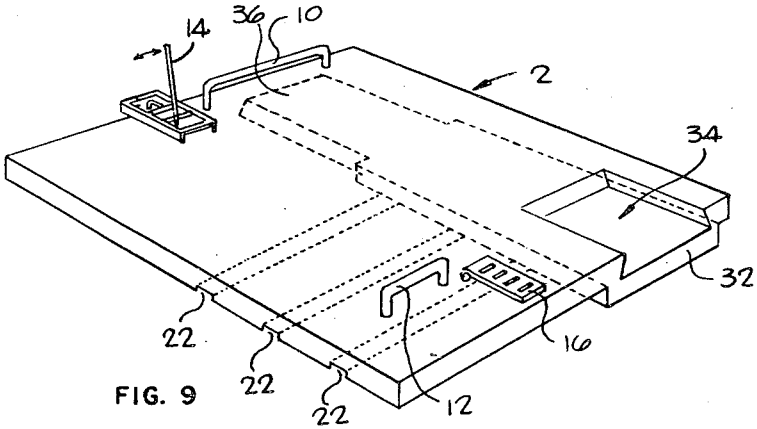
FIG. 9 is a perspective view of the embodiment shown in FIG. 7.

In the embodiments according to FIGS. 2 through 6, the upper portion of the skirt 2 has a molded protruding portion 18 adapted to contact pipe part 4 during wrapping of the skirt to provide for a positive sealing connection. A slight variation of this molded protruding portion is shown in FIGS. 4 and 5 by numeral 20 but the purposes of portions 18 and 20 are the same.

To permit for the downward escape of pressurized drilling fluid or mud the inner surface of the skirt is provided with a number of vertical grooves or channels shown by numeral 22 and it will be appreciated that when the skirt is wrapped around the pipe connection that any fluid or mud issuing from the joint will pass downwardly within the skirt to discharge back into the well bore.

Sealing means may also be provided along the vertical edges of the skirt so that these edges provide sealed mating when the skirt is positioned around the pipe connection. With reference to FIGS. 2 and 3, the outer surface of the skirt body may be provided with vertical ribs 24 which upon wrapping become engaged in groove 26 provided on the inner surface of the skirt adjacent the other vertical edge.

In the embodiment shown in FIGS. 4 and 5, this vertical sealing arrangement may be accomplished by the provision of sharpened ridges 28 adapted to meet with corresponding grooves 30 as shown clearly in FIG. 5.

The embodiments as illustrated in FIGS. 7 through 10 inclusive is generally similar to the embodiment discussed above, but the upper sealing means in this embodiment differs somewhat from the sealing means discussed earlier. More specifically, the inner surface of the body portion 2 has a molded inwardly extending protrusion portion 32 which, when the skirt is wrapped around the pipe is in sealing contact with the pipe connection. The outer surface of the skirt may then be provided with a molded indentation 34 to receive the end 36 of the protrusion 32 when the skirt is wrapped around the pipe connection to ensure a positive seal. Although not specifically shown in FIGS. 7 through 10, suitable vertical sealing means such as 24, 26, 28, and 30, as shown in FIGS. 2 through 5 may conveniently be provided.

The embodiments as discussed above with reference to FIGS. 2 through 10 inclusive all show the use of the present skirt to direct a drilling fluid or mud downwardly so that it is directed back into the drill hole.

Figure 11:
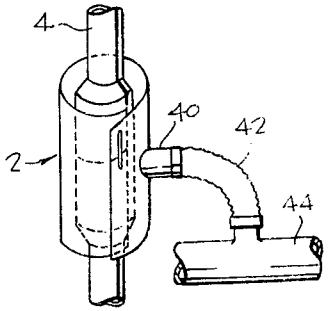
FIG. 11 illustrates in perspective view a further embodiment of the present invention partially positioned around a drill pipe joint.
Figure 12:
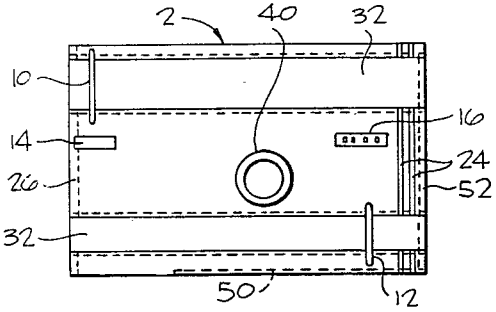
FIG. 12 is a side view of the outer surface of the embodiment as illustrated in FIG. 11.
Figure 13:
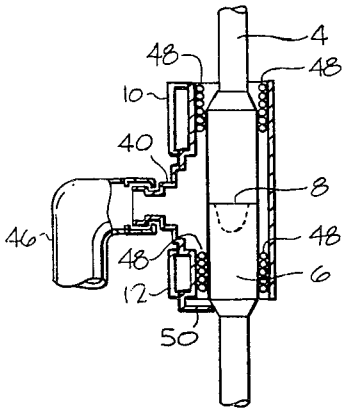
FIG. 13 is a partially sectioned view showing the present skirt in position around a drill stem connection and in accordance with the embodiment as shown in FIG. 11.

Accompanying FIGS. 11 through 13 show an embodiment of the invention wherein upper and lower seals are provided so that the drill mud or fluid issuing from the connection is conveyed back to storage and reuse.

The skirt as shown in FIG. 11 is similar to the arrangement discussed earlier but in this embodiment a nipple 40 is centrally provided in the skirt body and suitable tubing connection 42 and 44 convey drilling fluid to storage and/or re-use.

In the embodiment as shown in FIGS. 11 and 12, sealing means are provided along the upper and lower edges of the skirt body. As shown in FIG. 12, upper and lower protrusion portions 32 similar to the arrangement shown in FIGS. 7 to 10 may be used. Alternatively, and as shown in FIG. 13, rubber seals 48 may be molding integrally with the skirt body on the inner surface of the skirt and which contact and seal against the pipe portions upon wrapping of the skirt in position.

A lower anti-life flange 50 may be provided a distance along the lower edge of the skirt body to assist in holding the skirt in position.

The vertical edge 52 of the skirt 2 may be bevelled as shown in FIG. 12; and as shown in FIG. 13 an elbow 46 may be provided on nipple 40 to direct drilling fluid downwardly.

I claim:

1. A drilling fluid skirt for well drilling means, and which is wrapped around a drill pipe or well tool connection having upper and lower connecting parts prior to loosening of the connecting parts to contain pressured spray of drilling fluid, mud or water and minimize loss thereof, the skirt comprising a flexible body portion of length greater than the circumference of the connection about which it is adapted to be wrapped to cover adjacent portions of the connecting parts, and including means for locking the skirt in wrapped contact around the connection, the outer surface of the skirt adjacent one vertical edge having vertically extending grooves or ribs for mating contact with vertically extending ribs or grooves respectively provided on the inner surface of the skirt adjacent the other vertical edge, the skirt having handles provided on the outer surface to facilitate positioning, the skirt having an inner surface with bottom portions of the inner surface of the skirt having sealing means for respective contact with the upper and lower connecting parts during wrapping to prevent passage of drilling fluid or mud or water therebetween, and discharge means comprising a discharge opening with discharge nipple provided centrally in the skirt between the upper and lower sealing means for discharging drilling fluid or mud or water from within the skirt.

2. A skirt according to claim 1, including tubing means connected to the discharge nipple to conduct drilling fluid, mud or water for re-use or storage.

* * * * *